US006270239B1

(12) United States Patent
Sund

(10) Patent No.: US 6,270,239 B1
(45) Date of Patent: Aug. 7, 2001

(54) FADER WHEEL FOR LIGHTING CONTROL CONSOLE

(75) Inventor: David C. Sund, Dane, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 09/067,367

(22) Filed: Apr. 27, 1998

(51) Int. Cl.[7] ..... F21V 33/00

(52) U.S. Cl. ..... 362/295; 362/85; 362/233; 362/235; 323/235; 338/162

(58) Field of Search ..... 362/85, 233, 235, 362/295; 323/235; 338/162, 153, 116

(56) References Cited

U.S. PATENT DOCUMENTS 4,823,069 * 4/1989 Callahan et al. ..... 323/235
4,947,302 * 8/1990 Callahan ..... 362/233
4,975,629 * 12/1990 Callahan et al. ..... 323/235
4,984,138 * 1/1991 Graham ..... 362/85
5,225,765 * 7/1993 Callhan et al. ..... 323/235
5,319,301 * 6/1994 Callahan et al. ..... 323/235
5,376,914 * 12/1994 Matsui et al. ..... 338/116
5,455,748 * 10/1995 cotton et al. ..... 362/85
5,769,527 * 6/1998 Taylor et al. ..... 362/85
5,936,512 * 8/1999 Lohner ..... 338/150

OTHER PUBLICATIONS

Strand Lighting Catalogue 1997/1998.
Strand Lighting Mini Lightpalette Brochure.
ADB Vision 10/ST Brochure.

* cited by examiner

*Primary Examiner*—Stephen Husar
*Assistant Examiner*—Anabel Ton
(74) *Attorney, Agent, or Firm*—Mason, Kolehmainen, Rathburn & Wyss; Philip M. Kolehmainen

(57) ABSTRACT

A fader wheel assembly for a lighting control console includes a fader wheel having a single hub mounted at an acute angle to the top wall of the console. The inclined orientation positions approximately half of smooth, rounded outer wall and rim surfaces above the console top wall in an arrangement that is comfortable for the user. A single bearing locates the wheel as well as a transducer that is supported essentially only by its attachment to the fader wheel. Resilient arms lightly hold the transducer in position.

19 Claims, 3 Drawing Sheets

FADER WHEEL FOR LIGHTING CONTROL CONSOLE

FIELD OF THE INVENTION

The present invention relates to lighting control apparatus for stage and studio applications, and more particularly to an improved fader wheel for lighting control consoles.

DESCRIPTION OF THE PRIOR ART

Lighting control consoles are used by lighting designers to control stage and studio lighting. A typical console includes a variety of input devices such as keys, sliders and wheels used by the lighting designer to create cues including selected lighting fixtures and to vary the intensity and other characteristics of the light provided by the selected fixtures. With the console, the designer can control fixtures in a sequence of cues directly, in real time, and also can record a sequence of cues for replay at a later time.

One important input device provided by known lighting control consoles is the fader wheel. The fader wheel is a rotatable wheel connected to a position sensing transducer, typically an encoder, for translating wheel movement into an electrical signal. This signal is used to control lamp intensity changes. In a typical application, for a given cue, the wheel is rotated to create fades by smoothly and gradually increasing or decreasing light intensity of one or more dimming channels.

A fader wheel as known in the past is usually a relatively massive body having substantial inertia that promotes smooth fading transitions. The wheel is usually mechanically or electrically damped in order to minimize overtravel. A segment of the wheel extends up through an opening in the top wall of the console and the accessible projecting wheel segment can be manipulated by the user. Known fader wheels are relatively large, for example a few inches in diameter, so that they can be turned with a rolling motion of the hand or fingers and can provide fine resolution. The mass of the fader wheel requires secure rotational mounting. Typically the wheel is supported by bearings engaging opposed hubs at both sides of the wheel. Consistent with this typical mounting system, the wheel is oriented in a plane perpendicular to the console top wall, with its rotational axis parallel to and located just beneath the console top wall.

One of the hubs of the typical fader wheel is coupled to a rotating input shaft of the stationary transducer. The transducer housing is mounted in a fixed position, for example by attachment to a rigid bracket. For consistent and reliable operation and long service life, it is necessary that the opposed wheel hubs and bearings as well as the transducer be precisely axially aligned. This requires precision in manufacturing and assembling the typical fader wheel assembly.

A lighting designer in the process of programming a complex production having many cues with light intensity changes uses the fader wheel a great deal over extended periods of time. Repetitive operation of the conventional type of wheel can be fatiguing because of the vertical orientation of the wheel as well as the shape, size, mass and damping of the wheel.

SUMMARY OF THE INVENTION

A principal object of the present invention is to provide an improved fader wheel assembly for lighting control consoles such as are used for control and programming of stage and studio lighting. Other objects are to provide a fader wheel assembly that is comfortable and easy to use and minimizes operator fatigue; to provide a fader wheel assembly having a mounting arrangement that results in an ergonomically improved wheel orientation promoting precise control and a natural feel and permitting electrical damping or force feedback with minimum operator fatigue; to provide a fader wheel assembly in which the necessity and expense of precise axial alignment of bearings and transducers is eliminated; and to provide a fader wheel assembly overcoming long standing problems of fader wheels used in the past.

In brief, in accordance with the invention there is provided a fader wheel assembly for a lighting control console having a top wall with a fader wheel aperture. The fader wheel assembly includes a wheel having a rotational axis and opposed inner and outer sides symmetrical about the axis. The inner side includes a projecting mounting hub located at the axis. A mounting assembly for mounting the wheel for rotation about the axis includes a bearing located under the top wall adjacent the aperture for supporting the hub and wheel for rotational motion. The mounting system supports the wheel with a segment of the wheel projecting upward through the aperture. The outer side of the wheel includes a continuous, uninterrupted plane smoothly extending across and around the axis. The mounting system supports the wheel with the axis disposed at an angle to the top wall.

In accordance with another aspect of the invention there is provided a fader wheel assembly for mounting to a wall of a lighting control console. The assembly includes a massive fader wheel having a diameter in excess of about two inches. An axial hub projects from one side of the wheel. A bearing rotatably supports the hub. A bearing support engages the bearing and is adapted to be attached to the wall of the lighting control console. A rotation sensing transducer has a housing and an input member rotatable relative to the housing. The input member is coaxial with and drivingly connected to the hub. The bearing support and the bearing support the mass of the wheel. The driving connection of the hub to the input member provides substantially the entire support of the transducer. A retainer connected between the support and the transducer housing prevents rotation of the housing.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 1:
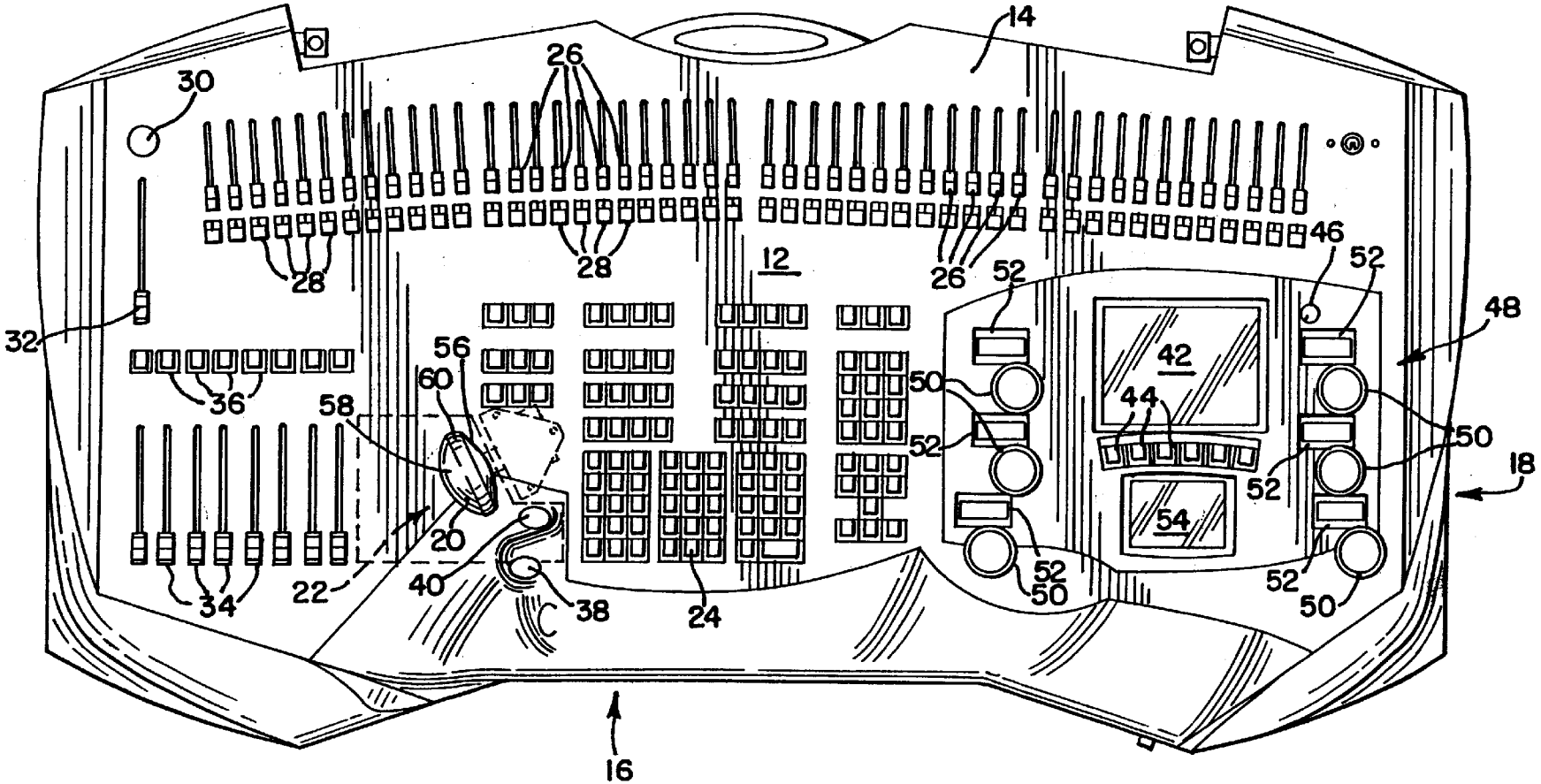
FIG. 1 is a top plan view of a lighting control console including a fader wheel assembly constructed in accordance with the present invention.
Figure 2:
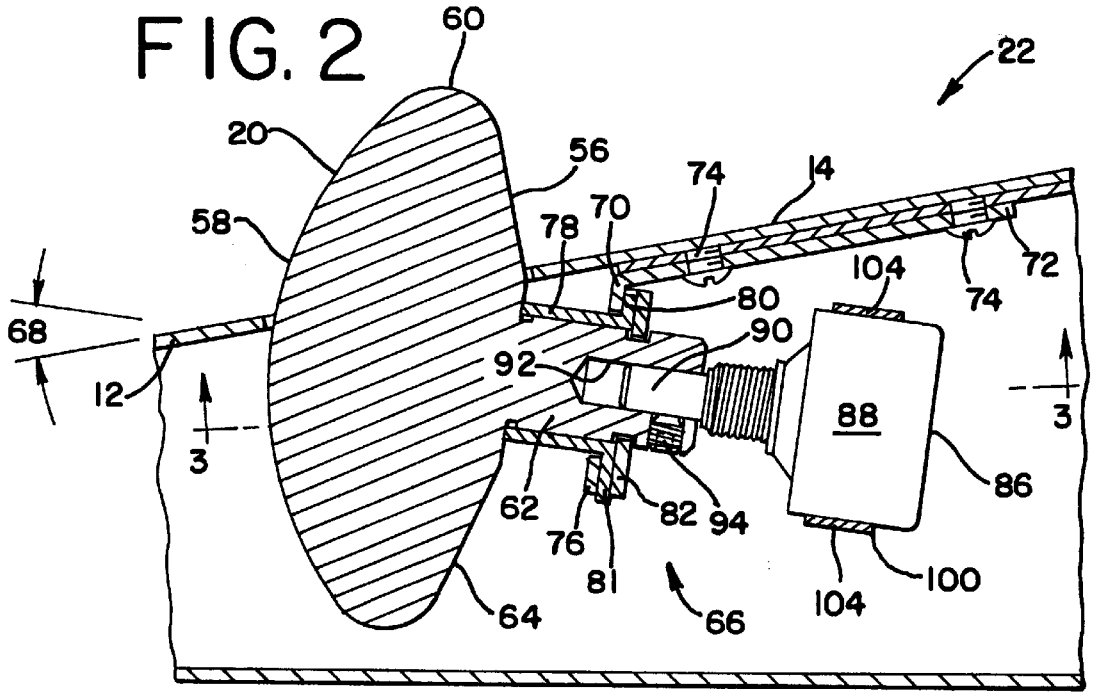
FIG. 2 is an enlarged, vertical, cross sectional view of the fader wheel assembly taken in the plane of the axis of rotation of the fader wheel.
Figure 3:
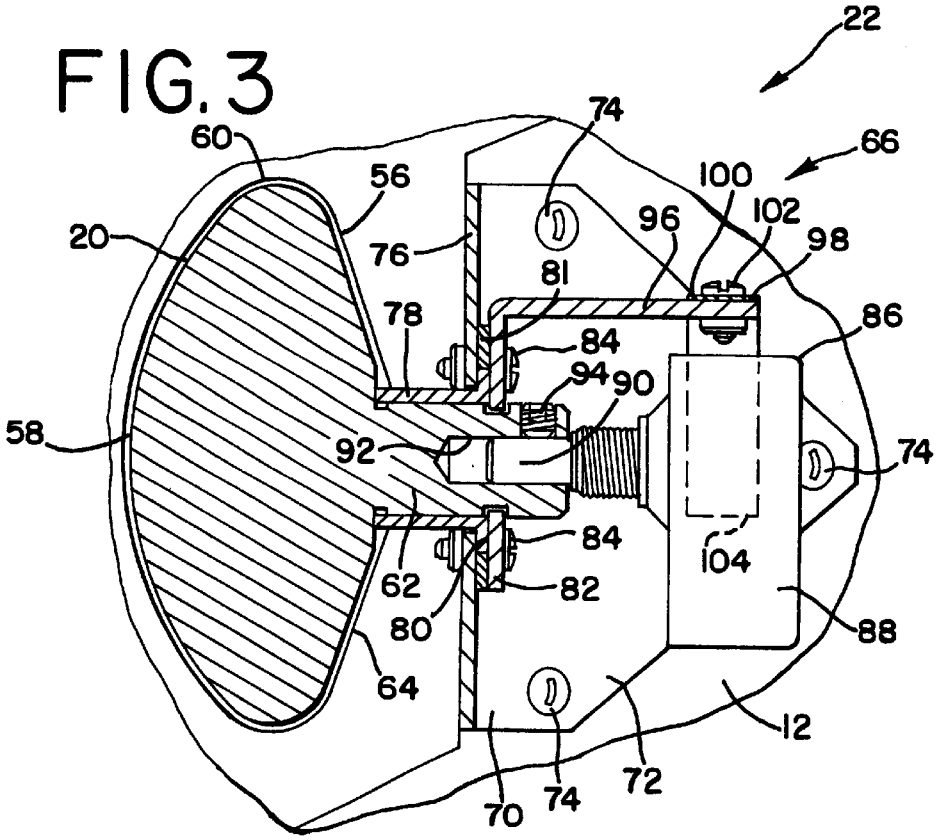
FIG. 3 is a cross sectional view taken along the line 3—3 of FIG. 2.
Figure 4:
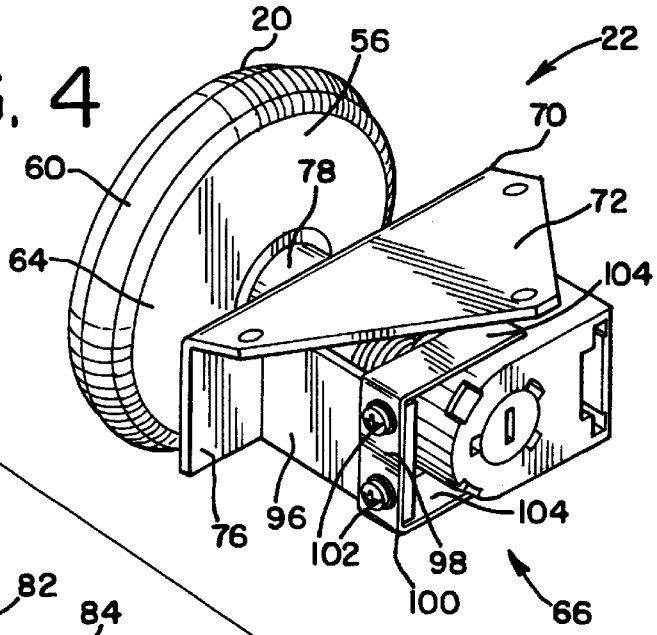
FIG. 4 is a top and rear isometric view of the fader wheel assembly removed from the lighting control console.
Figure 5:
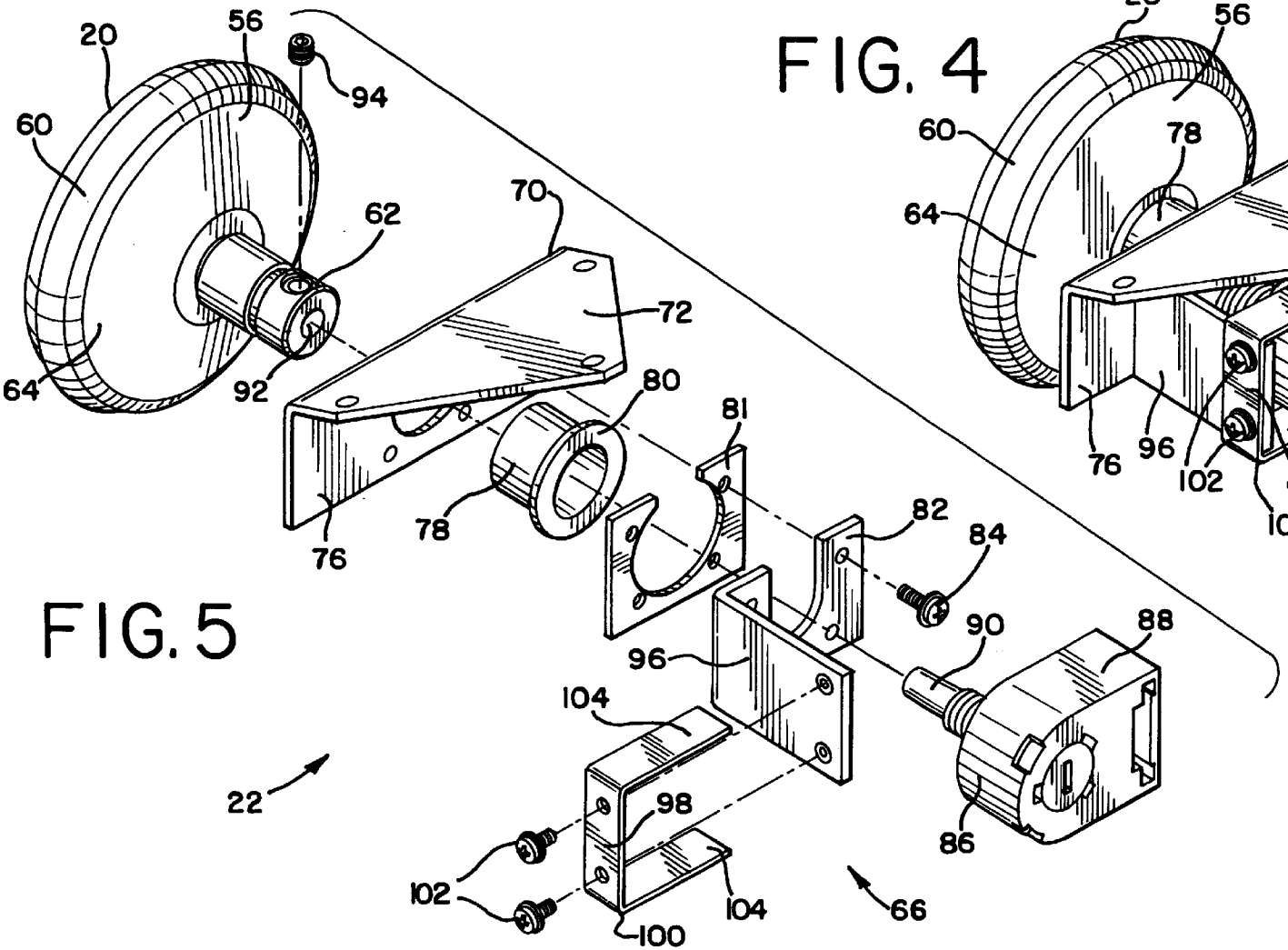
FIG. 5 is an exploded isometric view of the components of the fader wheel assembly.

Having reference now to the drawings, in FIG. 1 there is illustrated a lighting control console designated as a whole by the reference character 10. The console 10 is used by a lighting designer for controlling and recording lighting cues for stage and studio productions and for playing back a recorded series of cues with manual control and override capabilities. The console 10 includes a top wall 12 defining a control surface 14 containing a main control region 16 and a moving light control region 18. The main control region 16 includes a fader wheel 20 that is part of a fader wheel assembly generally designated as 22 illustrated in detail in FIGS. 2–5 and constructed in accordance with the principles of the present invention.

The main control region 16 includes a keypad 24 for user input. Using the keypad 24, the lighting designer can define numerous dimming channels used for control of light fixtures during a stage or studio production. The designer can define a number of lighting cues that are executed sequentially during the production. For example, when each cue is executed, the channels associated with that cue are controlled to obtain desired lighting effects by light intensity changes, or fades.

The main control region 16 includes a series of submaster sliders 26 and bump buttons 28 that can be used to control specific looks that the designer may, for example, incorporate into cues. A blackout button 30 and a grandmaster slider control 32 can be used to override and simultaneously control all or many dimmer channels, for example in an emergency. A group of fader sliders 34 and selector buttons 36 can be used during playback of a cue to take manual control of fading operations. A go button 38 is used during playback to advance from cue to cue, and a stop/back button 40 is used to stop a cue in progress or to return to a previous cue.

The moving light control region includes a touch screen 42 that provides programmable graphically displayed touch buttons as determined by operation of page select buttons 44. Screen contrast is adjusted by a knob 46. A number of moving light control stations 48 each include a control knob 50 that is placed in control of one parameter of a moving light, and a display window 52 providing information about the parameter and its status. The controlled parameters, for example, may include pan, tilt, gel color, focus, gobo wheel position, beam angle and others. A touch pad pointing device 54 can be used to manipulate parameters of a selected moving light such as pan and tilt.

Rotation of the fader wheel 20 is the most common way for a lighting designer to create fades. A large number of cues are needed for a typical stage or studio production having several scenes. For each cue, the lighting designer can use the fader wheel 20 to vary light intensity of one or more dimmer channels as part of the lighting design process. Use of the wheel has the advantage that the process is interactive. The designer can turn the wheel while observing the light intensity changes on the stage or in the studio. For this reason when a series of many cues is generated, the fader wheel 20 may be used almost continuously for an extended period of time. The fader wheel 20 may be assigned a different function during cue playback, such as manual override of fade rate. It is important that the fader wheel be convenient and comfortable to use.

The fader wheel assembly 22 of the present invention provides improvements in the "feel" and operation of the fader wheel 20 that are effective in reducing fatigue and increasing productivity. In accordance with the invention, the wheel is oriented in a position inclined to vertical and presents a convenient and easily manipulated surface area to the user.

In the illustrated embodiment of the invention, the fader wheel 20 is a unitary and one-piece body of material such as metal having a maximum diameter of more than two inches, and preferably about three inches. Wheel 20 includes an inner wall 56, an opposed outer wall 58 and a peripheral rim area 60. The wheel includes a single hub 62 aligned with the axis of rotation of the wheel 20. The hub 62 projects from the center of the inner wall 56. Both the inner and outer walls 56 and 58 are symmetrical about the axis of rotation of the wheel.

The outer wall 58 of the wheel 20 is convex and has a rounded shape. In the illustrated embodiment the surface of outer wall 58 has the shape of a segment of a sphere with a center located at or near the point where the hub 62 projects from the inner wall 56. The outer wall does not include a hub or other projection or discontinuity. Instead, the outer wall is a continuous, uninterrupted plane smoothly extending across and around the axis of rotation of the wheel 20.

The inner wall 58 is also convex. However, unlike the outer wall 58, it has a frustoconical shape with a continuous annular conical surface 64 disposed at an angle slightly offset from perpendicular to the axis of rotation of the wheel 20. The rim area 60 is rounded and smooth, with no corners, and provides a smooth transition between the outer and inner walls 58 and 56.

Rather than using the conventional wheel orientation with the axis of rotation parallel to the console top wall 12, a mounting system generally designated as 66 supports the wheel 20 for rotation about an axis that is inclined at an acute angle 68 (FIG. 2) to the control surface 14 provided by the console top wall 12. As a result of the use of the single hub 62 together with the angular mounting of the wheel 20, nearly half of the surface of the outer wall 58 and of the rim area 60 are accessible above the control surface 14.

Comfort and ease of use are enhanced by the rounded, smooth, continuous surface of the outer wall 58 and the smoothly rounded surface of the rim area 60. The conical surface 64 of the inner wall 56 is perpendicular to the control surface 14 because it is inclined at an angel equal to the angle 68 to a plane perpendicular to the axis of rotation of the wheel 20. As a result, the hand of the user falls easily and naturally onto the outer wall 58 and rim area 60 without interference from the inner wall 56. The wheel configuration and orientation encourage the hand to be relaxed and cupped over the wheel 20. In this position the hand is positioned comfortably as the wheel is rotated by the user. In the illustrated embodiment of the invention, the angle 68 is 18 degrees, but a range of acute angles would provide the advantages of the present invention to some degree.

The mounting system 66 includes a rigid mounting bracket 70 with a first flange 72 attached under the top wall 12 by fasteners 74. The bracket 70 includes a second flange 76 angularly disposed relative to the first flange 72 at an angle complementary to the angle 68. A bearing 78 rotatably supports the hub 62. Bearings of various types could be used. In the illustrated embodiment, the bearing 78 is a sleeve bearing having a radial flange 80 nested within a spacer plate 81 and captured against the second flange 76 by a mounting plate 82 and fasteners 84.

A transducer 86 in the form of an optical encoder provides electrical signals in response to rotation of the wheel 20. Alternatively, a stepper motor or other transducer could be used. If desired, the transducer can apply electrical damping or force feedback to the wheel 20. The transducer 86 includes a housing 88 and a projecting rotary input shaft 90 coaxial with the wheel 20. The weight of the transducer 86 is mechanically supported essentially only by its connection to the wheel 20. The hub 62 includes an axial opening 92 receiving the transducer input shaft 90 where it is secured by a set screw 94. This interconnection is strong enough to attach the transducer 86 securely to the wheel 20 and to support the weight of the transducer 86 with no additional support.

When the wheel 20 is rotated, rotation is imparted to the input shaft 90. In order to hold the transducer housing 88 in a stationary position, a rigid support flange 96 extends inwardly from the mounting plate 82. The plate 82 and the flange 96 are preferably a single bracket. A base portion 98 of a U-shaped retaining member 100 is attached to the end of the support flange 96 by fasteners 102. Member 100 is formed of a flexible resilient spring material and includes a pair of spaced apart flexible spring arms 104 extending around the transducer housing 88. The arms 104 lightly embrace the housing 88 and prevent it from rotating during operation of the wheel 20.

The fader wheel assembly 22 includes only a single bearing 78 and a single hub 62. The mounted position of the bearing 78 established by the mounting system 66 thus determines the position of the wheel 20 and its rotational axis. Because the transducer is supported by the wheel 20 and is only lightly retained by the arms 104, the transducer position is also determined by the position of the single bearing 78. Fabrication and assembly are simplified because it is not necessary to achieve alignment of additional supports and bearings such as a second wheel bearing for an opposed second wheel hub or an additional bearing or other support for the transducer. It is not necessary to use a flexible shaft or flexible coupling to accommodate eccentric rotation of the transducer.

While the present invention has been described with reference to the details of the embodiment of the invention shown in the drawing, these details are not intended to limit the scope of the invention as claimed in the appended claims.

What is claimed is:

1. A fader wheel assembly for a lighting control console having a top wall with a fader wheel aperture, said fader wheel assembly comprising:

a wheel having a rotational axis and opposed inner and outer sides symmetrical about said axis;

said inner side including a projecting mounting hub located at said axis;

a mounting assembly for mounting said wheel for rotation about said axis, said mounting assembly including a bearing means located under the top wall adjacent the aperture for supporting said hub and wheel for rotational motion;

said mounting system supporting said wheel with a segment of said wheel projecting upward through the aperture;

said fader wheel assembly being characterized by:

said mounting system supporting said wheel with said axis being disposed at an angle to the top wall.

2. The fader wheel assembly of claim 1, said outer side of said wheel including a continuous, uninterrupted plane smoothly extending across and around said axis.

3. The fader wheel assembly of claim 1, said axis being disposed at an acute angle to said top wall.

4. The fader wheel assembly of claim 2, approximately half of said continuous, uninterrupted plane being accessible above the top wall.

5. The fader wheel assembly of claim 2, said continuous, uninterrupted plane being convex.

6. The fader wheel assembly of claim 5, said continuous, uninterrupted plane being a segment of a sphere.

7. The fader wheel assembly of claim 2, said inner side having a convex, conical portion disposed approximately perpendicular to the top wall.

8. The fader wheel assembly of claim 7, said wheel including a continuously rounded rim joining said inner and outer sides.

9. The fader wheel assembly of claim 1, further comprising a motion sensing transducer connected to said hub.

10. The fader wheel assembly of claim 9, said wheel and said transducer being disposed at opposite sides of said bearing means.

11. The fader wheel assembly of claim 10 said mounting means further including a mounting bracket for supporting said bearing means.

12. The fader wheel assembly of claim 11 further comprising means connected between said bracket and said transducer for preventing rotation of said transducer while permitting movement of said transducer relative to said bracket.

13. A fader wheel assembly for mounting to a wall of a lighting control console, said assembly comprising:

a massive fader wheel having a diameter in excess of about two inches;

an axial hub projecting from one side of said wheel;

a bearing rotatably supporting said hub;

a bearing support engaging said bearing and adapted to be attached to the wall of the lighting control console;

a rotation sensing transducer having a housing and an input member rotatable relative to said housing;

said input member being coaxial with and drivingly connected to said hub;

said fader wheel assembly being characterized by:

said bearing support and said bearing supporting the mass of said wheel;

said driving connection of said hub to input member providing substantially the entire support of said transducer; and a retainer connected between said support and said transducer housing to prevent rotation of said housing;

said retainer including an arm having a free end, said arm engaging said transducer housing.

14. The fader wheel assembly of claim 13, said bearing comprising a tubular sleeve.

15. The fader wheel assembly of claim 13, said bearing support including a rigid flange fixed to said bearing and adapted to be fixed to the lighting control console wall.

16. The fader wheel assembly of claim 13, said arm being resilient.

17. A fader wheel assembly for mounting to a wall of a lighting control console, said assembly comprising:

a massive fader wheel having a diameter in excess of about two inches;

an axial hub projecting from one side of said wheel;

a bearing rotatably supporting said hub;

a bearing support engaging said bearing and adapted to be attached to the wall of the lighting control console;

a rotation sensing transducer having a housing and an input member rotatable relative to said housing;

said input member being coaxial with and drivingly connected to said hub;

said fader wheel assembly being characterized by:

said bearing support and said bearing supporting the mass of said wheel;

said driving connection of said hub to input member providing substantially the entire support of said transducer; and a retainer connected between said support and said transducer housing to prevent rotation of said housing;

said retainer including a pair of arms engaging opposed portions of said transducer housing.

18. The fader wheel assembly of claim 17, said arms being resilient.

19. The fader wheel assembly of claim 18, said bearing support including rigid mounting flange means fixed to said bearing and adapted to be fixed to said lighting control console wall, said resilient arms projecting from said rigid mounting flange means.

* * * * *